US006092884A

United States Patent [19]

Katz

[11] Patent Number: 6,092,884

[45] Date of Patent: Jul. 25, 2000

[54] DOOR FOR CABINET AND METHOD FOR CONSTRUCTING SAME

[75] Inventor: Howard S. Katz, Riegelsville, Pa.

[73] Assignee: Robern, Inc., Bristol, Pa.

[21] Appl. No.: 08/915,362

[22] Filed: Aug. 20, 1997

Related U.S. Application Data

[63] Continuation of application No. 08/685,131, Jul. 24, 1996, abandoned.

[51] Int. Cl.[7] ..... A47B 67/00

[52] U.S. Cl. ..... 312/225; 312/227; 312/245

[58] Field of Search ..... 312/242, 245, 312/227, 321.5, 206, 211; 15/257.01

[56] References Cited

U.S. PATENT DOCUMENTS

| | | | |
|---|---|---|---|
| D. 281,476 | 11/1985 | Smith, Jr. . | |
| 1,006,481 | 10/1911 | Johnson et al. . | |
| 1,254,132 | 1/1918 | Garman | 312/245 X |
| 2,678,252 | 6/1954 | Swearingen . | |
| 3,138,414 | 6/1964 | Pollo | 312/245 X |
| 4,134,625 | 1/1979 | Palka . | |
| 4,858,336 | 8/1989 | Varma . | |
| 4,929,039 | 5/1990 | Thomas et al. | 312/213 |
| 5,139,322 | 8/1992 | Aisley . | |
| 5,511,873 | 4/1996 | Mech | 312/227 |
| 5,833,330 | 11/1998 | Kos | 312/245 X |

*Primary Examiner*—Peter M. Cuomo
*Assistant Examiner*—Stephen Vu
*Attorney, Agent, or Firm*—Akin, Gump, Strauss, Hauer & Feld, L.L.P.

[57] ABSTRACT

A door for a cabinet includes a frame with a first mounting surface and a second mounting surface, the first mounting surface and said second mounting surface being located on the same side of said frame. The door further includes a first mirror having a surface disposed against the first mounting surface of the frame and a second mirror having a surface disposed against the second mounting surface of the frame. In a preferred embodiment, the door includes at least one holder integrally formed with the frame, which is preferably shaped to receive and support at least one toothbrush. The door for a cabinet is constructed by providing a frame including the first mounting surface and the second mounting surface on the same side of the frame, locating a first mirror within the frame so that a surface of the first mirror is disposed against the first mounting surface of the frame, and locating the second mirror on said frame so that a surface of the second mirror is disposed against the second mounting surface of the frame.

14 Claims, 7 Drawing Sheets

DOOR FOR CABINET AND METHOD FOR CONSTRUCTING SAME

CROSS-REFERENCE TO RELATED APPLICATIONS

This application is a continuation of U.S. patent application No. 08/685,131, filed on Jul. 24, 1996, now abandoned.

FIELD OF THE INVENTION

The present invention relates to doors for cabinets and a method of constructing the same.

BACKGROUND OF THE INVENTION

It is well known to construct a door for a cabinet which includes at least one mirror mounted to the door frame. Typically, such doors are pivotally mounted to the frame of a cabinet to enable the door to be swung open from a closed position and thereby provide access to the interior of the cabinet.

It is further known to construct a door for a cabinet with two mirrors, one being mounted so as to face outward from the cabinet when in the door is in a closed position and the other being mounted so as to face the interior of the cabinet when the door is in the closed position. Often, especially with a door for a bathroom cabinet, the interior facing mirror is used to assist a user in the application of make-up, and for other such uses, while the cabinet is opened.

It is also known to provide holder devices which are most often mounted to or built into a shelf or an interior surface of the cabinet. Although these devices are usually simple devices which are relatively inexpensive and fairly easily fabricated, even a simple device adds cost to the manufacturing process. Manufacturing costs could be reduced if the holders were integrated into the structure of the door itself so as to be fabricated concurrently with the construction of the door.

SUMMARY OF THE INVENTION

Briefly stated, in one aspect, the present invention is a door for a cabinet comprising a frame including a first mounting surface and a second mounting surface, the first mounting surface and the second mounting surface being located on the same side of the frame. The door further includes a first mirror having a surface disposed against the first mounting surface of the frame and a second mirror having a surface disposed against the second mounting surface of the frame.

In a second aspect, the invention is a door for a cabinet the door including a frame having at least one holder integrally formed with said frame. In a third aspect, the invention is a method of constructing a door for a cabinet, including the steps of: providing a frame including a first mounting surface and a second mounting surface, the first mounting surface and the second mounting surface being located on the same side of the frame; locating a first mirror within the frame so that a surface of the first mirror is disposed against the first mounting surface of the frame; and placing a second mirror on the frame so that a surface of the second mirror is disposed against the second mounting surface of the frame.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings, which are diagrammatic, embodiments which are presently preferred. It should be understood, however, that the invention is not limited to the precise arrangements and instrumentalities shown. In the drawings:

FIG. 8, are elevation views of the second preferred embodiment, each showing the door attached to an opposite side of a cabinet.

DETAILED DESCRIPTION OF PREFERRED EMBODIMENTS

Figure 1:
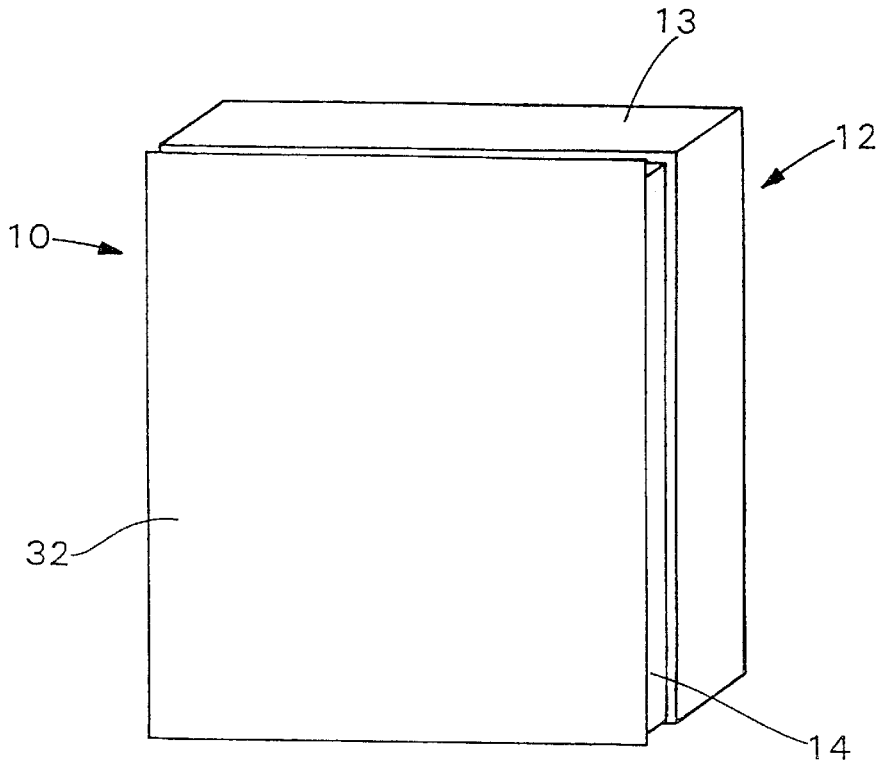
FIG. 1 is a perspective view of a door for a cabinet in accordance with a first embodiment of the present invention, shown mounted to a cabinet.

Certain terminology is used in the following description for convenience only and is not limiting. The words "right", "left", "lower" and "upper" designate directions in the drawing to which reference is made. The words "inner" and "outer" refer to directions toward and away from, respectively, the geometrical center of the door and/or cabinet, and designated parts thereof. The words "inward-facing" and "outward-facing" refer to the sides of a frame which will face toward and away from, respectively, a cabinet after the mounting of the door to the cabinet. The terminology includes the words above specifically mentioned, derivatives thereof and words of similar import.

Figure 3:
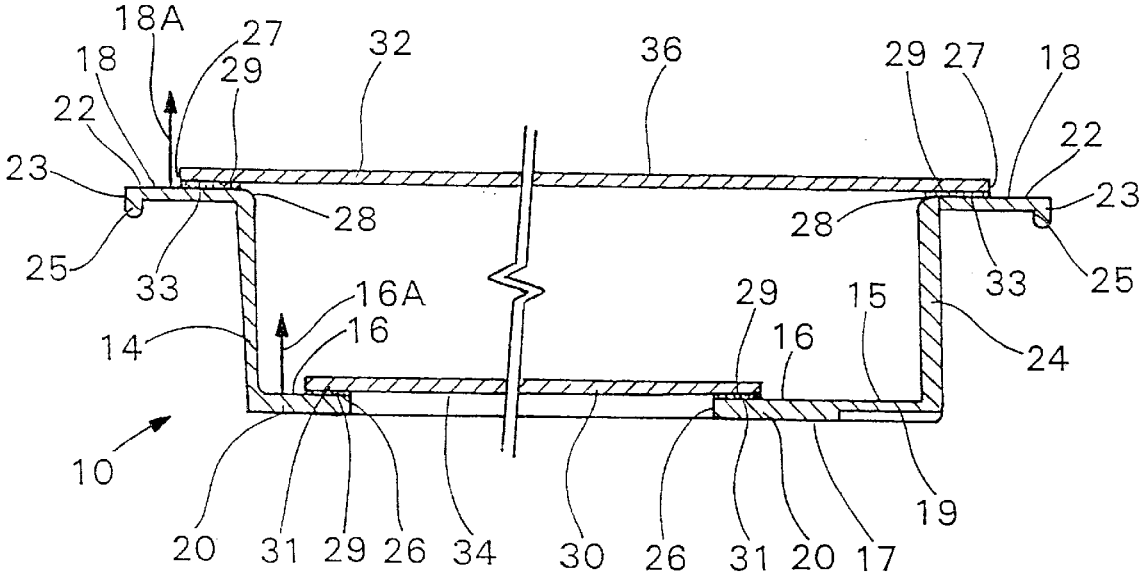
FIG. 3 is a non-proportional cross-sectional view taken along line 3—3 of FIG. 2 showing one method of mounting the mirrors to the door frame.
Figure 2:
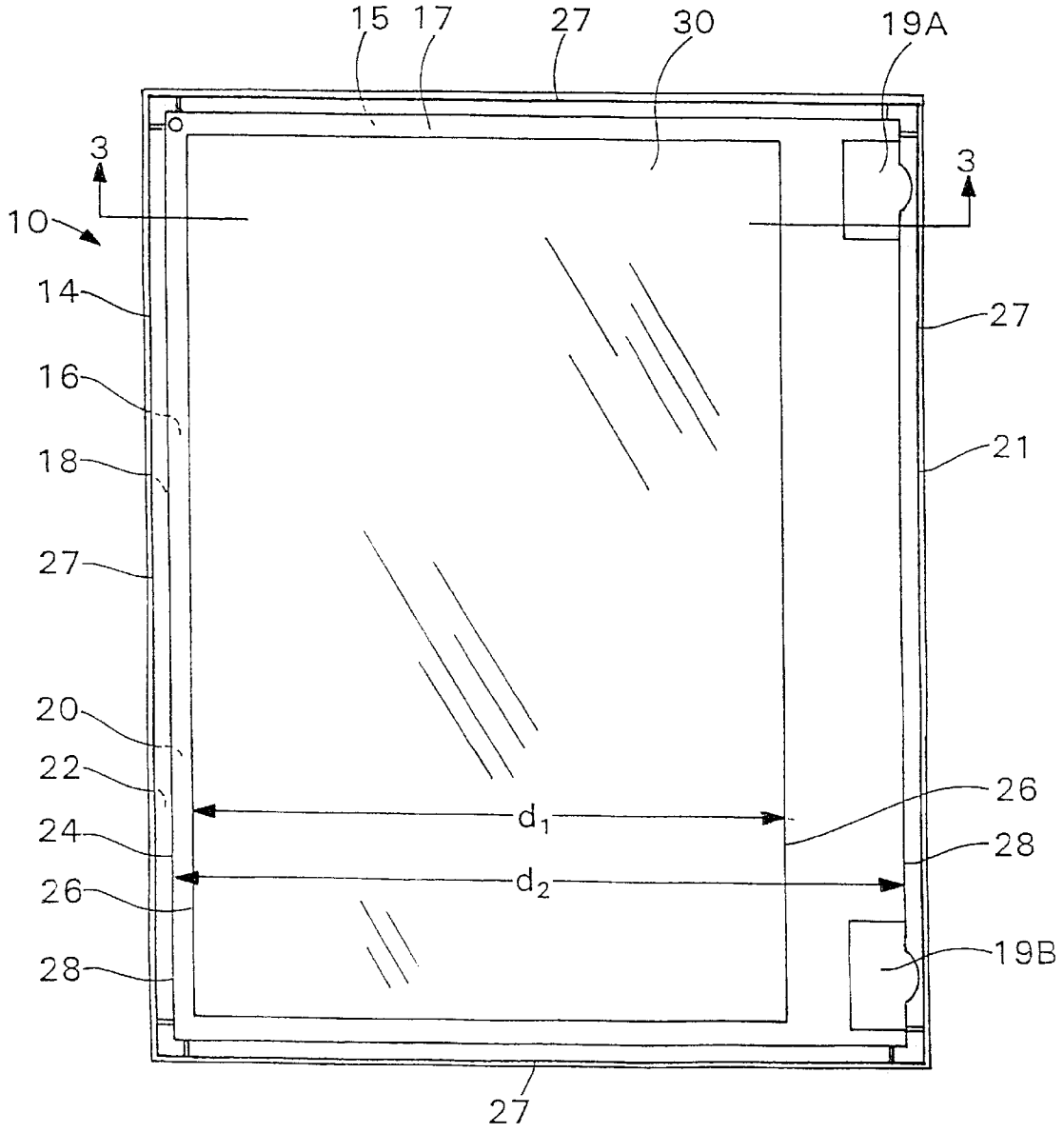
FIG. 2 is a rear elevational view of the door of FIG. 1.

Referring now to the drawings in detail, wherein like numerals are used to indicate like elements throughout, there is shown in FIGS. 1–3 a first preferred embodiment of a door 10 for a cabinet 12. The door 10 is comprised of a frame 14 including a first mounting surface 16 and a second mounting surface 18. The first mounting surface 16 and the second mounting surface 18 are located on the same side of the frame 14, preferably the outward-facing side 17 when the door 10 is mounted to the cabinet 12, and in substantially parallel planes. The frame 14 further includes an inner ledge 20 and an outer ledge 22 connected by a web 24. The first mounting surface 16 is located on the inner ledge 20 and the second mounting surface 18 is located on the outer ledge 22.

The inner ledge 20 of the frame 14 has at least one pair of parallel edges 26 separated by a first distance $d_1$ and the outer ledge 22 has at least one pair of parallel edges 28 separated by a second distance $d_2$, with the first distance $d_1$ being less than the second distance $d_2$. The inner ledge 20 and the outer ledge 22 are constructed so that a line 16*a* extending normal to the first mounting surface 16 of the inner ledge 20 is parallel to and extends in the same direction as a line 18*a* extending normal to the second mounting surface 18 of the outer ledge 22. In other words, the first mounting surface 14 and the second mounting surface 16 are preferably flat, parallel to each other and located so that first mounting surface 16 is more proximate to the center of the frame 14 than is second mounting surface 18.

Preferably, the frame 14 further includes a finger pull 25, which is constructed as a rounded, flange-like projection extending generally about the entire perimeter of the frame 14 and disposed at the outer edges 23 of the outer ledge 22 on the inward-facing side 17 of the frame 14, as is shown in FIGS. 3 and 4. The finger pull 25 assists a user in pivotally displacing the door 10 relative to the cabinet 12, as discussed in more detail below, by providing a surface upon which to exert a pulling force. However, it is well within the capabilities of those skilled in the art to provide the frame 14 with other appropriate means of assisting a user to pivotally displace the door 10 with respect to the cabinet 12, such as by including a knob (not shown) attached to the frame 14. The frame 14 may further include hinge mounting surfaces 19A, 19B (FIG. 2) near opposite ends of a mounting edge 21 of the frame 14. The hinge mounting surfaces 19A, 19B provide areas for attaching hinges to mount the door 10 to the cabinet 12, as is discussed in more detail below. Preferably, the hinge mounting surfaces 19A, 19B are recesses integrally formed with the frame 14.

The frame 14 is preferably constructed of a molded polymeric material, such as high impact polystyrene. However, it is within the scope of the present invention to construct the frame 14 of any other appropriate material, such as fiberglass, aluminum or steel. It is also within the scope of the present invention to fabricate the frame 14 by any other appropriate manufacturing process, such as, for example, stamping or casting.

Referring again to FIGS. 1–4, the door 10 for a cabinet 12 of the present invention further includes a first mirror 30 having a surface 31 disposed against the first mounting surface 16 of the frame 14. The door 10 also includes a second mirror 32 having a surface 33 disposed against the second mounting surface 18 of the frame 14. Preferably, the second mirror 32 is sized so that the side edges 27 of the second mirror 32 extend beyond the outer edges 23 of the outer ledge 22 of the frame 14, as shown in FIGS. 1–2, 5–6 and 8. However, it is within the scope of the present invention to size the second mirror 32 so that the side edges 27 do not extend beyond the outer edges 23 of the outer ledge 22 of the frame 14, as is shown in FIGS. 3 and 4.

When the first mirror 30 and the second mirror 32 are located within frame 14, the first mirror 30 and the second mirror 32 overlap each other. Preferably, the first mirror 30 and the second mirror 32 are assembled within the frame 14 so that the reflective side 34, the side one views to obtain a reflection, of the first mirror 30 faces outward from the inward-facing side 17 of the frame 14 and the reflective side 36 of the second mirror 32 faces outward from the outward-facing side 15 of the frame 14. In other words, the reflective side 34 of the first mirror 30 and the reflective side 36 of the second mirror 32 will face in opposite directions.

In the presently preferred embodiment of the present invention, the first mirror 30 and the second mirror 32 are fabricated from planar glass of a generally rectangular shape, as shown in FIGS. 1–5. However, it will be appreciated by those skilled in the art that the first mirror 30 and the second mirror 32 can be concave or convex curved mirrors, with the capability of magnifying or reducing a reflected image, and/or could be fabricated of some other shape, such as circular. The present invention is intended to embrace all other possible constructions of the first mirror 30 and the second mirror 32.

Preferably, the first mirror 30 is attached to the first mounting surface 16 by an adhesive material 29 and the second mirror 32 is attached to the second mounting surface 18 by an adhesive material 29, as shown in FIG. 3. Such an adhesive material could include double-sided tape, glue, an epoxy-resinous material or one of a variety of similar substances. Furthermore, it is within the scope of the present invention to provide brackets or some other mechanical means for attaching the mirrors to the respective mounting surface, if desired (not shown).

Figure 4A:
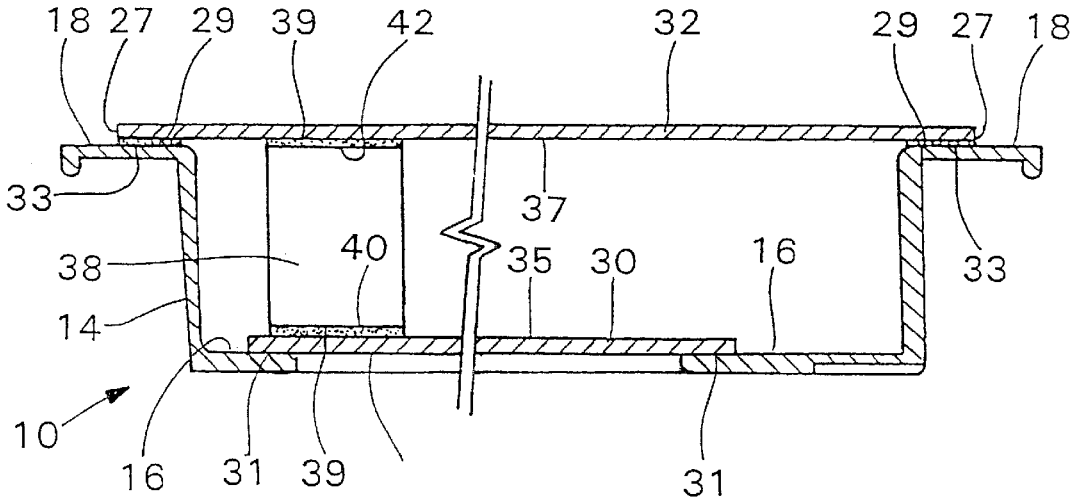
FIGS. 4A and 4B, collectively known as FIG. 4, are cross-sectional views similar to FIG. 3 each illustrating alternative methods of mounting the mirrors to the door frame which include utilizing a spacer block.
Figure 4B:
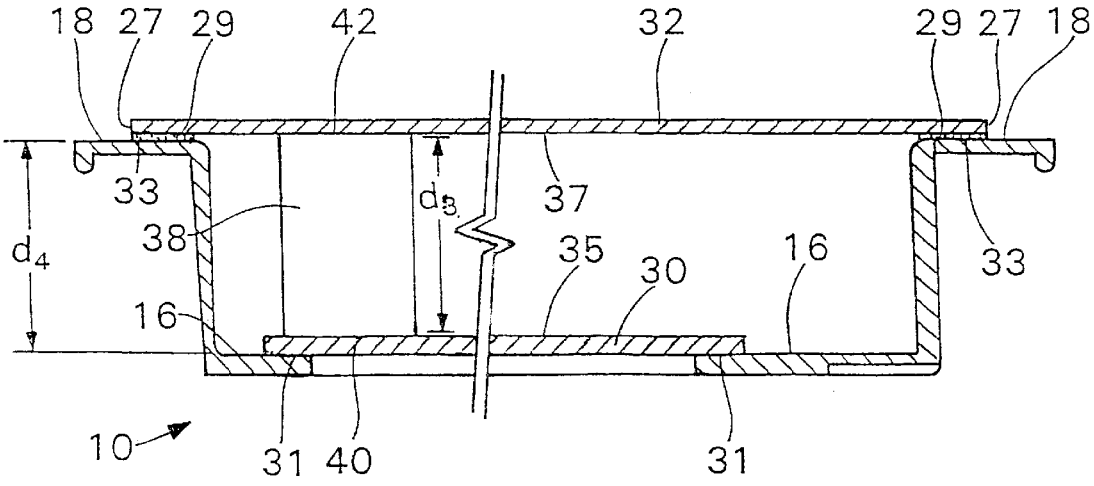

Alternatively, as shown in FIG. 4, the first mirror 30 can be located in the frame 14 so that the surface 31 of the first mirror 30 is freely disposed against the first mounting surface 16, in other words, so that the surface 31 of the first mirror 30 merely lays against the first mounting surface 16, while the second mirror 32 is attached to the second mounting surface 18 as described above. At least one spacer block 38, and preferably two or more spacer blocks 38, can be included in the door 10 between the first mirror 30 and the second mirror 32 so that a first surface 40 of each spacer block 38 is disposed against a rear side 35 of the first mirror 30 and a second surface 42 of each spacer block 38 is disposed against a rear side 37 of the second mirror 32. The first mirror 30 can then be secured in position by one of two preferred methods. In the first method, as shown in FIG. 4A, an adhesive material 39 is applied between the first surface 40 of each spacer block 38 and the rear side 35 of the first mirror 30 and between the second surface 42 of each spacer block 38 and the rear side 37 of the second mirror 32. This causes the first mirror 30, the second mirror 32 and the spacer blocks 38 to be an essentially rigid unit which can be secured in place by the attachment of the first mirror 30 to the first mounting surface 16 or the second mirror 32 to the second mounting surface 18, or both, for example with an adhesive material 29. In the second method, as shown in FIG. 4B, each spacer block 38 is constructed so that the distance $d_3$ between the first surface 40 of the spacer block 38 and the second surface 42 of the spacer block 38 is greater than the distance $d_4$ between the first mounting surface 16 and the second mounting surface 18. Thus, when the first mirror 30 is disposed against the first mounting surface 16 and the second mirror 32 is disposed against and attached to the second mounting surface 18, for example, with an adhesive material 29, each spacer block 38 becomes compressed and generates a reaction force which causes the surface 31 of the first mirror 30 to be firmly pressed against the first mounting surface 16. In either attachment method utilizing one or more spacer blocks 38, each spacer block 38 is preferably fabricated from a easily compressible material, such as, for example, foam rubber.

The method of constructing the door 10 for a cabinet 12 is as follows. The door 10 is constructed by locating the first mirror 30 within the frame 14 so that the surface 31 of the first mirror 30 is disposed against the first mounting surface 16 of the frame 14. Then, the second mirror 32 is located on the frame 14 so that the surface 33 of the second mirror 32 is disposed against the second mounting surface 18 of the frame 14. The structure of the frame 14, with the first mounting surface 16 being located on the inner ledge 20 and the second mounting surface 18 being located on the outer ledge 22, with both mounting surfaces and ledges being located on the outward-facing side 15 of the frame 14, necessitates that the first mirror 30 be placed within the frame 14 before the second mirror 32 is placed on the frame 14. The first mirror 30 and the second mirror 32 are secured with the frame 14 by one of the techniques outlined above. The door 10 can then be attached to the frame 13 of a cabinet 12 by conventional means known to those skilled in the art, such as, for example, with two or more hinges enabling pivotal displacement of the door 10 relative to the cabinet 12.

Preferably, the cabinet 12 is a standard cabinet of the bathroom or medicine cabinet variety and frame 13 of cabinet 12 is constructed as an aluminum or steel box frame. However, it is understood by those skilled in the art that the present invention is not limited to any specific type, shape or size cabinet or any particular appropriate material.

Referring now to FIGS. 5–8, there is shown a second preferred embodiment of a door 110 for a cabinet 112 in accordance with the present invention. The second preferred embodiment of the door 110 is similar to the first preferred embodiment of the door 10 described above, and like elements have been designated with the same element numerals but with the addition of 100. The differences from the first embodiment of the door 10 are described in detail below.

The door 110 is comprised of a frame 114 which is substantially similar to the frame 14 of the first preferred embodiment, with the following differences. The frame 114 includes at least one holder 144, and preferably a plurality of holders 144, integrally formed with the frame 114. The holders 144 are preferably located on the inward-facing side 117 of the frame 114, as shown in FIGS. 5–8, although the holders 144 could be disposed on the outward-facing side 115, if desired.

Figure 5:
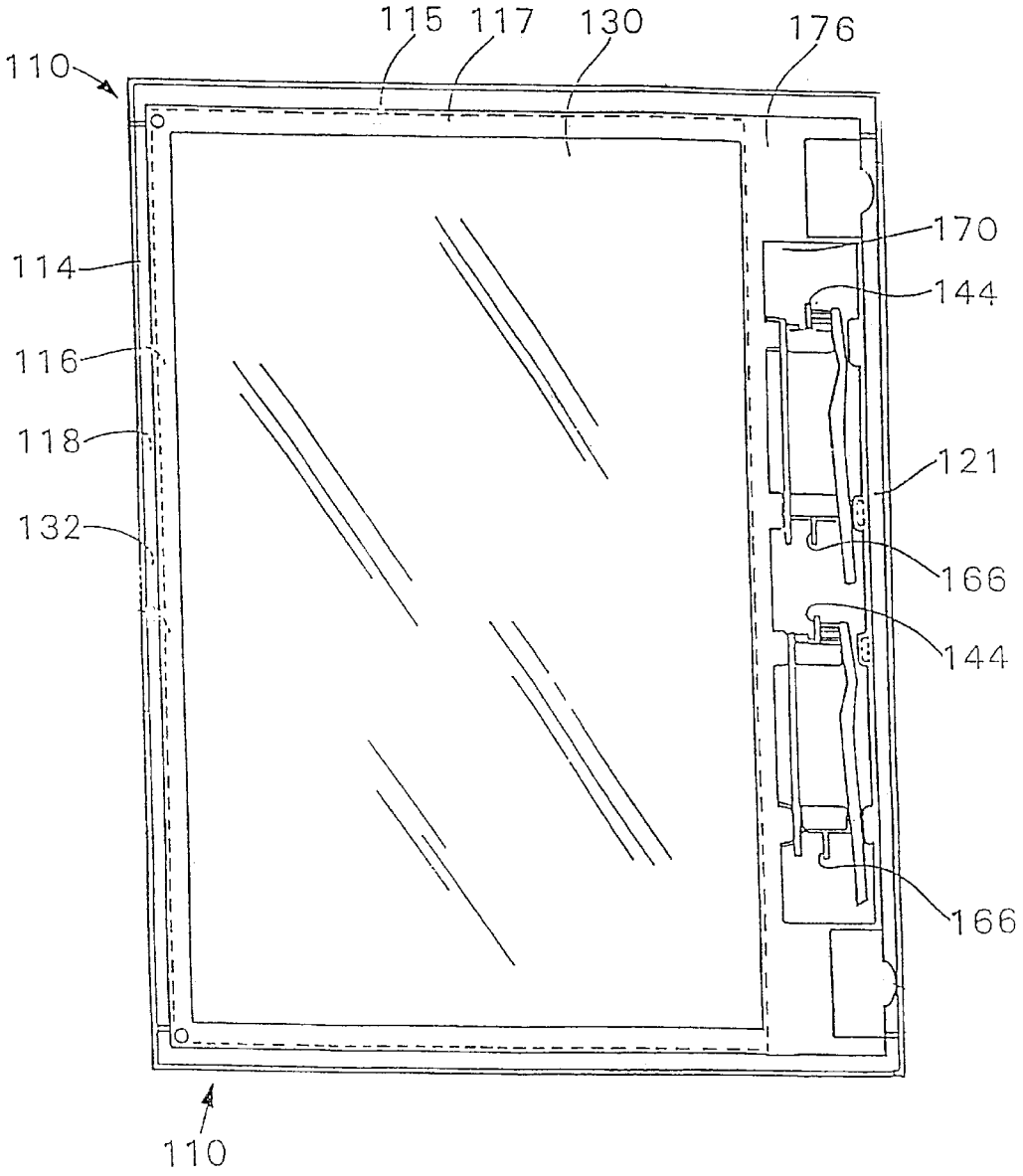
FIG. 5 is an elevational rear view of a door in accordance with a second preferred embodiment of the present invention, shown with toothbrushes in the holders.
Figure 7:
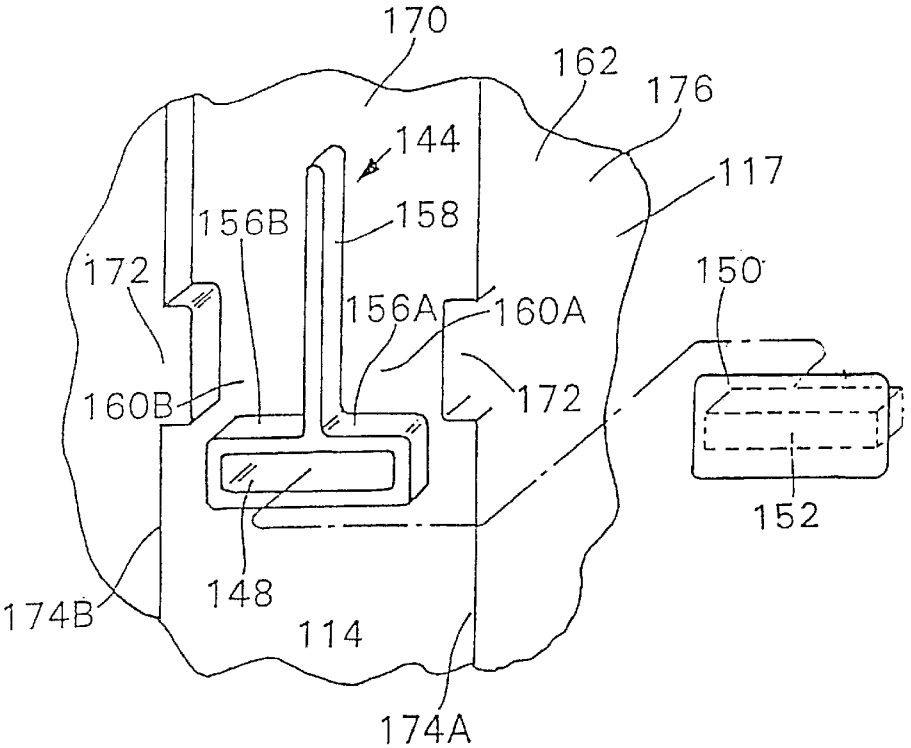
FIG. 7 is an enlarged perspective view of a holder of the type shown in FIGS. 5 and 6.
Figure 6:
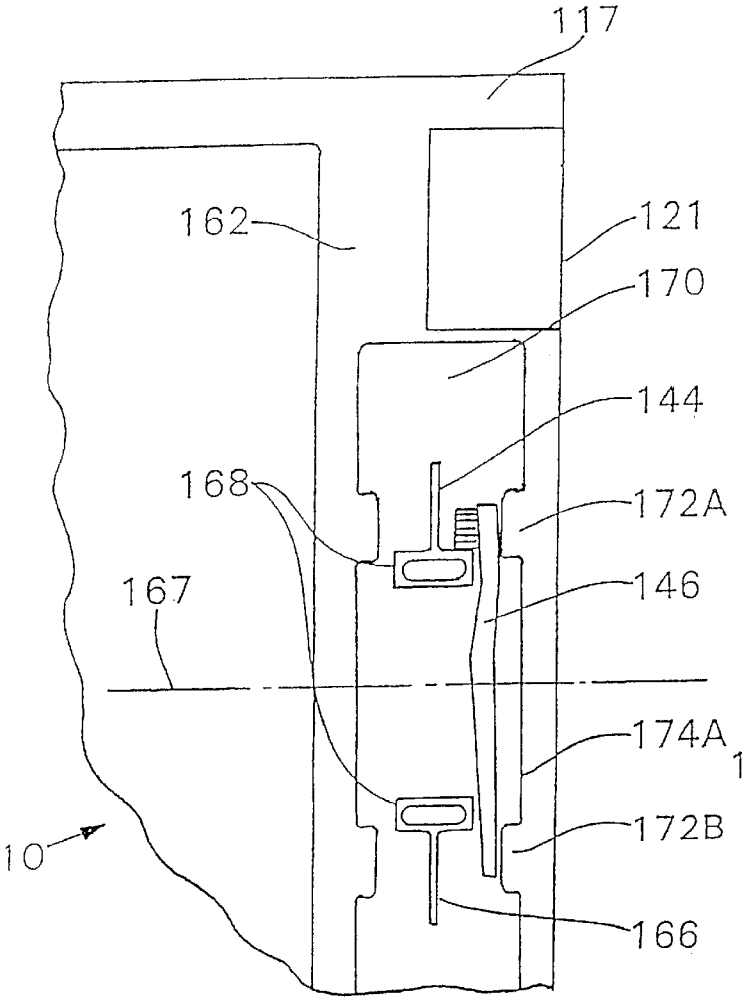
FIG. 6 is an enlarged portion of FIG. 5.

Referring to FIG. 7 in detail, in the presently preferred embodiment, each of the one or more holders 144 is shaped to receive and support at least one toothbrush 146. Each holder 144 includes a cavity 148 and a retainer cap 150, a portion 152 of the retainer cap 150 being disposed within the cavity 148. Preferably, the portion 152 of the retainer cap 150 is a projection having an ellipsoidal cross-section and the cavity 148 is formed to have a matching ellipsoidal cross-section, with both being constructed so that the projection is secured within the cavity 148 by a friction fit. Each holder 144 preferably further includes two ledges 156A, 156B and a divider wall 158 there between. When the portion 152 of the retainer cap 150 is assembled with the frame 114 by insertion into cavity 148, two holding pockets 160A, 160B are created, each of which is defined by one of the ledges 156A, 156B, one surface of divider wall 158, the inner surface of retainer cap 150 and a surface 162 of inward-facing side 117 of frame 114. A toothbrush 146 can be placed within a holding pocket 160A or 160B so that a portion of the brush head rests upon a ledge 156A, 156B, as illustrated in FIGS. 5 and 6.

Referring again to FIGS. 5–8, the frame 114 further includes at least one conjugate holder 166 which is identically constructed as a holder 144 and is oppositely disposed with respect to a holder 144. In other words, as best shown in FIG. 6, the elements of the conjugate holder 166 are disposed as if the conjugate holder 166 was the mirror image of the elements of the holder 144 reflected through the reference axis 167. Preferably, the number of the conjugate holders 166 is equal to the number of the holders 144 disposed on the frame 114. Each of the conjugate holders 166 is matched with one of the holders 144 to form a holder pair 168.

Figure 8A:
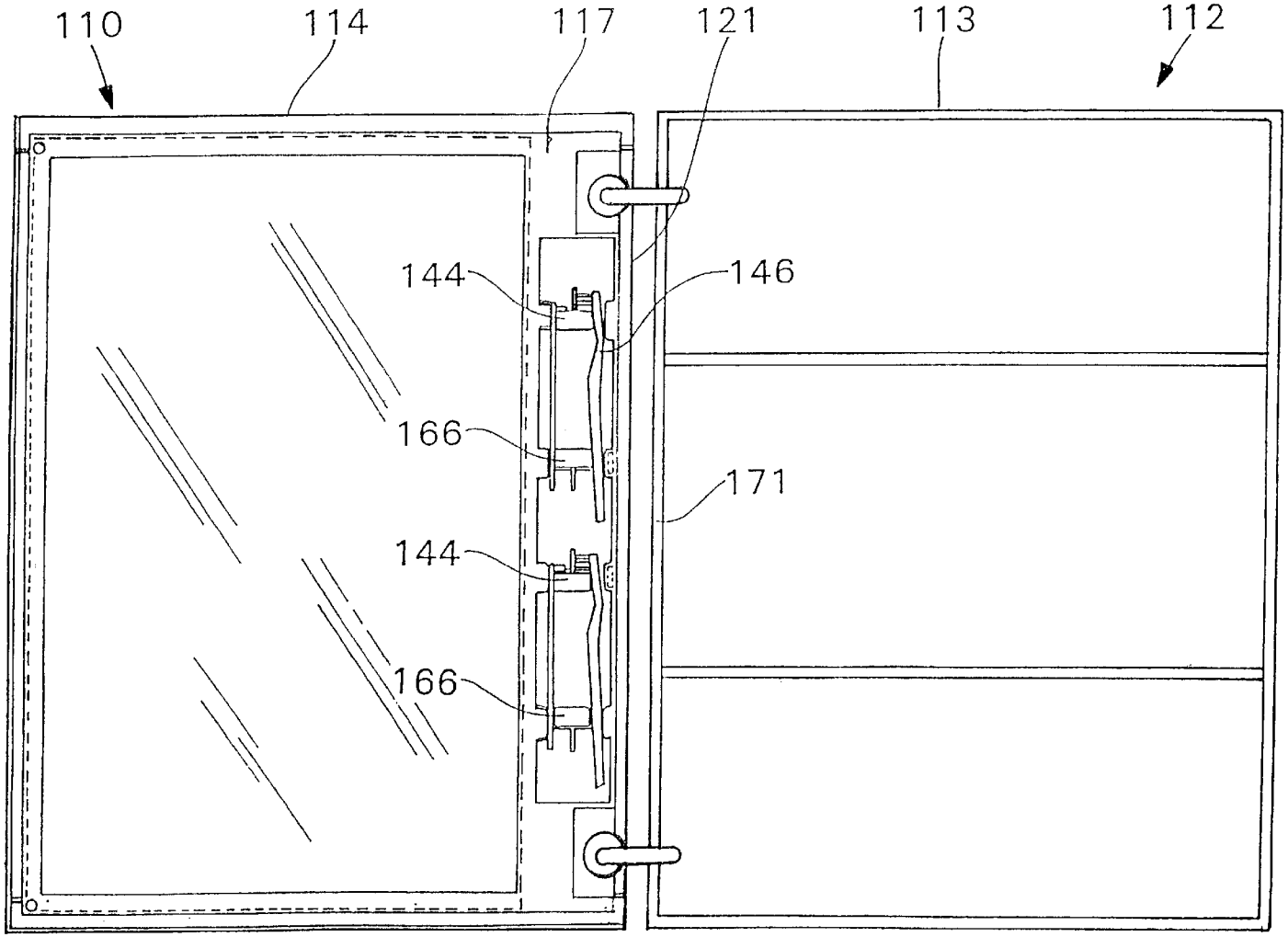
FIGS. 8A and 8B, collectively
Figure 8B:
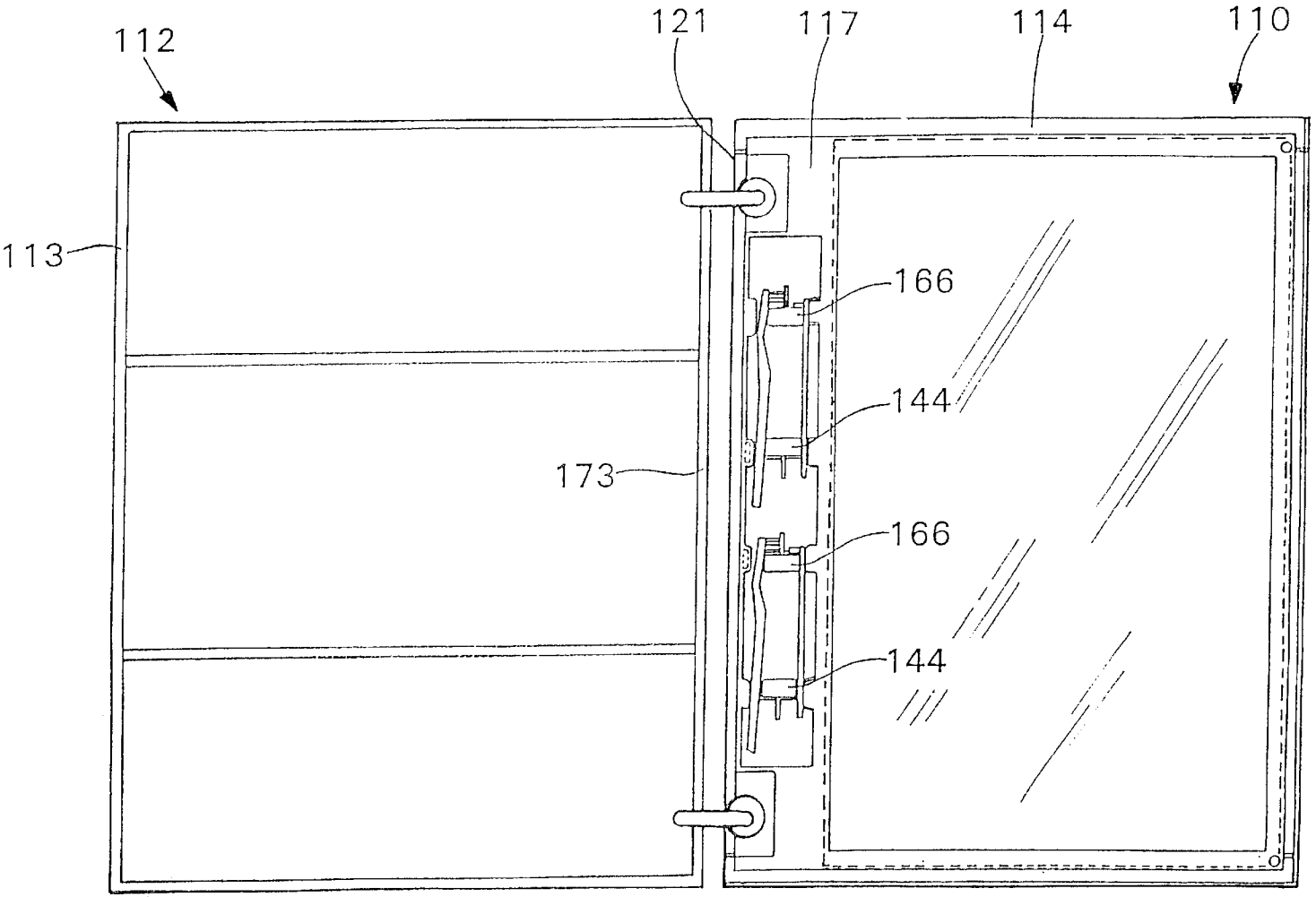

As illustrated in FIG. 8, the purpose of constructing door 110 to include the holder pairs 168, as opposed to including only one or more holders 144, is to provide the option of attaching the door 110 to either the right side 171 or the left side 173 of the frame 113 of the cabinet 112 while still enabling either the holders 144 or the conjugate holders 166 to support one or more toothbrushes 146. In a first mounting orientation as shown in FIG. 8A, the frame 114 of the door 110 is attached to the left side 171 of the frame 113 of the cabinet 112. In the first mounting orientation, door 110 displaces to an open position in a right-to-left direction and a user utilizes the one or more holders 144 to support one or more toothbrushes, as shown in FIG. 8A. In a second mounting orientation shown in FIG. 8B, the frame 114 of the door 110 is rotated 180 degrees and is attached to the right side 173 of the frame 113 of the cabinet 112. In the second mounting orientation, the door 110 displaces to an open position in a left-to-right direction and a user utilizes the one or more conjugate holders 166 to support a toothbrush 146, as shown in FIG. 8B. The door 110 can easily be alternated from first mounting orientation to second mounting orientation, and vice versa, prior to attaching the door 110 to the frame 113 of the cabinet 112 simply by rotating the door 110 180 degrees with respect to an axis (not shown) substantially perpendicular to a mounting edge 121 of the frame 114 or by rotating the cabinet 112.

Although the construction of the holders 144 and the conjugate holders 166 as described above is preferred, it is within the scope of the present invention to construct the holders 144 and the conjugate holders 166 of any other useful shape, such as, for example, constructing the holders as two arcuate members (not shown) extending from a surface of frame 114 and being constructed to enable a toothbrush or other object such as a drinking cup (not shown) to be received and supported between the arcuate members. The present invention is intended to embrace all other such useful shapes for the holders 144 and the conjugate holders 166 that are integrally formed with the frame 114.

Referring again to FIGS. 5–8, in the second embodiment as presently preferred, the frame 114 further includes a recess 170 formed within the frame 114 with one or more holders 144 and an equal number of the conjugate holders 166 being disposed within the recess 170. Referring to FIGS. 6 and 7, the recess 170 includes one or more support projections 172A, 172B extending inward from sidewalls 174A, 174B. Referring to FIG. 6, the support projections 172A, 172B provide either rear support for the head of a toothbrush 164 (projections 172A) or a resting surface for the lower rear portion of the handle of a toothbrush (projections 172B). However, it is within the scope of the present invention to construct the frame 114 without a recess 170, in which case the holders 144 and the conjugate holders 166 are disposed on a flat section 176 surface 162 of the inward-facing side 117 of the frame 114 where they project into the cabinet 112.

Preferably, the holders 144, the conjugate holders 166 and the recess 170 are disposed upon the inward-facing side 117 of frame 114. However, the holders 144, the conjugate holders 166 and the recess 170 could be disposed on the outward-facing side 115 of the frame 114.

Frame 114 is preferably constructed of a molded polymeric material, such as high impact polystyrene, with the holders 144, the conjugate holders 166 and the recess 170 being integrally formed in the mold or molds for the frame 114. However, it is within the scope of the present invention to construct the frame 114 of any other appropriate material, such as fiberglass or aluminum, and to fabricate the frame 114 by any other operation besides molding, such as stamping or casting. In such cases, the holders 144, the conjugate holders 166 and the recess 170 are be formed with the frame 114 by another appropriate method. For example, if the frame 114 was stamped from a material such aluminum, the holders 144, the conjugate holders 166 and the recess 170 could be formed as part of the frame 114 by the use of appropriate forming dies. The present invention is intended to embrace all possible combinations of materials and manufacturing operations by which the holders 144, the conjugate holders 166 and the recess 170 are capable of being integrally formed with the frame 114.

Referring to FIG. 5, preferably, the door 110 further includes a first mirror 130 disposed against a first mounting surface 116 (in phantom) beneath mirror 130 of frame 114 and a second mirror 132 disposed against a second mounting surface 118 (also in phantom) of frame 114, with frame 114 being constructed substantially identically to frame 14 of the first embodiment 10 with the addition of one or more holders 144, conjugate holders 166 and the recess 170. However, it is within the scope of the present invention to construct frame 114 with only a single mirror attached to the frame 114 in any suitable fashion as would be well within the capabilities of one skilled in the art.

The door 110 for a cabinet 112 is constructed in an identical fashion as the door 10 of the first preferred embodiment. Furthermore, the door 110 is also preferably mounted to the frame 113 of a cabinet 112 such as a bathroom or medicine type cabinet.

There are several advantages of the present invention over prior art doors for cabinets. The fact that the structure of the frame 14, 114 enables both mirrors of the door to be mounted from the same side of the frame has several advantages. The manufacturing process is simple. If the door 10, 110 is assembled in an automated process, inserting the mirrors into the frame 14, 114 from the same side eliminates the need to either rotate the door after mounting the first mirror 30, 130 or the process can utilize relatively simple and inexpensive equipment that does not require the mirrors to be mounted from two directions simultaneously or consecutively (i.e. from top and bottom or from front and rear). In a manual process, the assembler does not have to turn the door 10, 110 over after mounting the first mirror 30, 130 to mount the second mirror 32, 132. Furthermore, the structural integrity of a door 10, 110 with one mirror being mounted within an essentially enclosed space is greater than if two mirrors were mounted to opposing sides of the frame due to the virtual impossibility of the first mirror 30, 130 becoming detached from the frame 14, 114, respectively, and possibly shattering, during normal usage.

With regards to the holders 144 and the conjugate holders 166, a door 110 having holders integrally formed with the frame has several advantages. In the presently preferred construction in which the door 110 is constructed of molded plastic, such as by injection molding, the holder contours could be machined into the mold wall so that the holder is fabricated simultaneously with the frame of the door. Alternatively, if the door was stamped from aluminum, the holder can be formed in the same forming dies that produce the remainder of the frame. Therefore, in any case, several manufacturing steps and materials are eliminated in comparison with an independently constructed holding device with a corresponding reduction in manufacturing costs. The integrally formed holders 144 and conjugate holders 166 in a stamped aluminum version of the door 110 are less expensive to produce than a simple slot in a conventional stamped door, because piercing punches generally have to be replaced more frequently than forming punches and may require an extra piercing die. As compared to a simple slot constructed in an injection molded door, even if a trimming operation is not required to remove flashing about the perimeter of the molded slot, the simple slot clearly does not function as well or appear as aesthetically pleasing as the holders 144 and conjugate holder 166 of the present invention. Finally, the preferred embodiment of the present invention having pairs of holders 168 provides flexibility to the cabinet manufacturer to mount the door 110 to the cabinet frame 112 on either the left side 171 or the right side 173 of the frame 113 of the cabinet 112 and still enable either the holders 144 or the conjugate holders 166 to be utilized as intended.

It will be appreciated by those skilled in the art that changes could be made to the embodiments described above without departing from the broad inventive concept thereof. For example, the door 10 could be utilized with a cabinet 12 (not shown) with only one side edge having mounting surfaces for the door 10, so that the door 10 is always mounted to the same side edge of the cabinet 12. In such an embodiment, the whole door and cabinet assembly would be rotated to provide the capability of opening the door in either a right-to-left direction or a left-to-right direction. It is understood, therefore, that this invention is not limited to the particular embodiments disclosed, but it is intended to cover modifications within the spirit and scope of the present invention as defined by the appended claims.

I claim:

1. A door for a cabinet, said door comprising:

a frame adapted to be hingedly connectable to said cabinet and including a first mounting surface and a second mounting surface, said first mounting surface and said second mounting surface being located on a same side of said frame;

a first mirror having a first reflective surface, a surface of the first mirror being disposed against said first mounting surface of said frame; and a second mirror having a second reflective surface, a surface of the second mirror being disposed against said second mounting surface of said frame;

wherein said first reflective surface and said second reflective surface face outwardly from opposite sides of said frame.

2. The door as recited in claim 1, wherein said first mounting surface and said second mounting surface are located in substantially parallel planes.

3. The door as recited in claim 2, wherein said first mirror and said second mirror overlap each other.

4. The door as recited in claim 3, wherein said frame further includes an inner ledge and an outer ledge connected by a web, said first mounting surface being located on said inner ledge and said second mounting surface being located on said outer ledge.

5. The door as recited in claim 4, wherein said inner ledge of said frame has at least one pair of parallel edges separated by a first distance, said outer ledge has at least one pair of parallel edges separated by a second distance, said first distance being less than said second distance and said first ledge and said second ledge being constructed so that a line normal to said first mounting surface of said inner ledge is parallel to and extends in the same direction as a line normal to said second mounting surface of said outer ledge.

6. The door as recited in claim 1, wherein said frame further includes at least one holder integrally formed with said frame.

7. The door as recited in claim 6, wherein said at least one holder is shaped to receive and support at least one toothbrush.

8. The door as recited in claim 1 in combination with a bathroom cabinet, wherein said door is mounted to a frame of the cabinet.

9. A door for a bathroom cabinet, said door including a frame adapted to be hingedly connectable to a vertical side of said cabinet such that the door pivots with respect to said cabinet along a vertical axis and having at least one holder integrally formed with said frame along a vertical edge of the door, said at least one holder being a projection extending from a surface of said frame and having at least one ledge extending substantially perpendicular to said surface for supporting an item; said at least one holder being shaped to receive and support at least one toothbrush; the door further including at least one conjugate holder, said at least one conjugate holder being identically constructed as said at least one holder, the number of said conjugate holders being equal to the number of said holders on said frame and each of said conjugate holders being oppositely disposed with respect to said holders.

10. The door as recited in claim 9, wherein said door can be alternatively attached to opposite sides of a frame of said cabinet while enabling utilization of either said at least one holder or said at least one conjugate holder.

11. The door as recited in claim 9, wherein said door further includes at least one mirror mounted to said frame.

12. The door as recited in claim 9, wherein the at least one holder is recessed into the frame such that the at least one holder is located within a plane of the door.

13. The door as recited in claim 9, wherein said at least one holder includes a cavity and a retainer cap, a portion of said retainer cap being disposed within said cavity.

14. The door as recited in claim 9, wherein said frame further includes a recess formed within said frame and said at least one holder is disposed within said recess.

* * * * *